US005688061A

United States Patent [19]

Aoki

[11] Patent Number: 5,688,061

[45] Date of Patent: Nov. 18, 1997

[54] WRITING IMPLEMENT WITH STIRRING MEMBER

[75] Inventor: Takashi Aoki, Hino, Japan

[73] Assignee: Kabushiki Kaisha Allco, Tokyo-to, Japan

[21] Appl. No.: 560,342

[22] Filed: Nov. 17, 1995

[30] Foreign Application Priority Data

Nov. 18, 1994 [JP] Japan ..... 6-285287

[51] Int. Cl.[6] ..... B43K 7/10

[52] U.S. Cl. ..... 401/4; 401/214

[58] Field of Search ..... 401/4, 214

[56] References Cited

U.S. PATENT DOCUMENTS

| | | | |
|---|---|---|---|
| 3,000,355 | 9/1961 | Rosenthal | 120/42.4 |
| 4,198,172 | 4/1980 | Meislik | 401/214 |
| 5,468,082 | 11/1995 | Hori | 401/4 |

FOREIGN PATENT DOCUMENTS

| | | |
|---|---|---|
| 0622250 | 11/1994 | European Pat. Off. . |
| 1071169 | 8/1954 | France . |
| 1269299 | 7/1961 | France . |
| 2186359 | 1/1974 | France . |
| 2298444 | 8/1976 | France . |
| 547796 | 9/1942 | United Kingdom . |

*Primary Examiner*—Steven A. Bratlie
*Attorney, Agent, or Firm*—Ladas & Parry

[57] ABSTRACT

A writing implement comprises a tubular barrel containing an ink, a writing ball fitted in a socket formed in the tip of the barrel, and an ink stirring member sealed in the barrel so as to be movable to stir the ink so that the precipitated components of the ink are dispersed when the barrel is shaken. A helical spring is disposed within the barrel at a position near the writing tip of the barrel so that the front end thereof is in contact with the writing ball to press the ball resiliently forward and the back end thereof can be struck by the stirring member. When the barrel is shaken so that the stirring member may apply shocks to the back end of the helical spring, the helical spring vibrates slightly and the slight vibrations of the helical spring disperse the precipitated components of the ink and secure smooth ink flow.

7 Claims, 2 Drawing Sheets

WRITING IMPLEMENT WITH STIRRING MEMBER

BACKGROUND OF THE INVENTION

1. Field of the Invention

The present invention relates to a writing implement and, more specifically, to a ballpoint writing pen having a writing ball that transfers ink to a writing surface.

2. Description of the Related Art

A conventional writing implement of the type mentioned above comprises an elongate tapered barrel containing ink, a writing ball, i.e., the writing point, that rotates in a socket formed in the tip of the barrel, and a bar-shaped ink stirring member sealed in the barrel. A correction pen using white ink is a typical example of such a writing implement. The white ink for the correction pen is of a pigment dispersion type prepared by dispersing a pigment in a dispersion medium, and the pigment has a tendency to separate from the dispersion medium over time and precipitate. When the barrel of the writing implement is shaken immediately before using it for writing, the ink stirring member in the barrel stirs the ink to disperse the precipitated pigment in the dispersion medium.

In this conventional writing implement, the precipitated pigment cannot be fully dispersed simply by shaking the barrel to shake the stirring member. Consequently, it sometimes occurs that the color density of the ink transferred to the writing surface decreases during writing or the pigment deposits in the clearance between the writing ball and the socket impede the flow of the ink and faint and patchy characters and letters are written down.

SUMMARY OF THE INVENTION

Accordingly, it is an object of the present invention to provide a writing implement capable of maintaining the ink in a homogeneous dispersion, and of preventing the interruption of the ink flow that causes faint and patchy writing.

With the aforesaid object in view, the present invention provides a writing implement comprising a tubular barrel with a tip containing an ink prepared by dispersing a dispersoid in a dispersion medium, a writing element fitted in a socket formed in the tip of the barrel, and an ink stirring member sealed in the barrel so as to be movable to stir the ink so that precipitated dispersoid is dispersed when the barrel is shaken. The writing implement is characterized by a spring disposed within the barrel at a position near the tip of the barrel so that a front end thereof is in contact with the writing element to press the element resiliently forward and a back end thereof can be struck by the stirring member.

When the writing implement is shaken, the stirring member shakes and strikes the spring at its rear end to cause the spring to vibrate slightly. Consequently, both the slight vibrating action of the spring and the shaking action of the stirring member occur simultaneously to promote the dispersion of the dispersoid of the ink.

In this writing implement, the spring may be a helical spring having a front portion coiled at a relatively small pitch, a middle portion coiled at relatively large pitch and a back portion coiled at a relatively small pitch so that the back end of the helical spring may be restrained from movement by a part of the barrel.

When the back end portion of the helical spring is restrained from movement by a part of the barrel, the helical spring is not strained greatly by the shocks applied thereto by the stirring member and the helical spring vibrates slightly to disperse the separated and precipitated dispersoid again.

The above and other objects, features and advantages of the present invention will become more apparent from the following description taken in connection with the accompanying drawings.

DESCRIPTION OF THE PREFERRED EMBODIMENT

A writing implement in a preferred embodiment according to the present invention is a ballpoint writing implement containing, for example, a pigment ink, such as a white correction ink. The present invention is applicable also to a writing implement using an ordinary ink, such as a dye ink.

Figure 1:
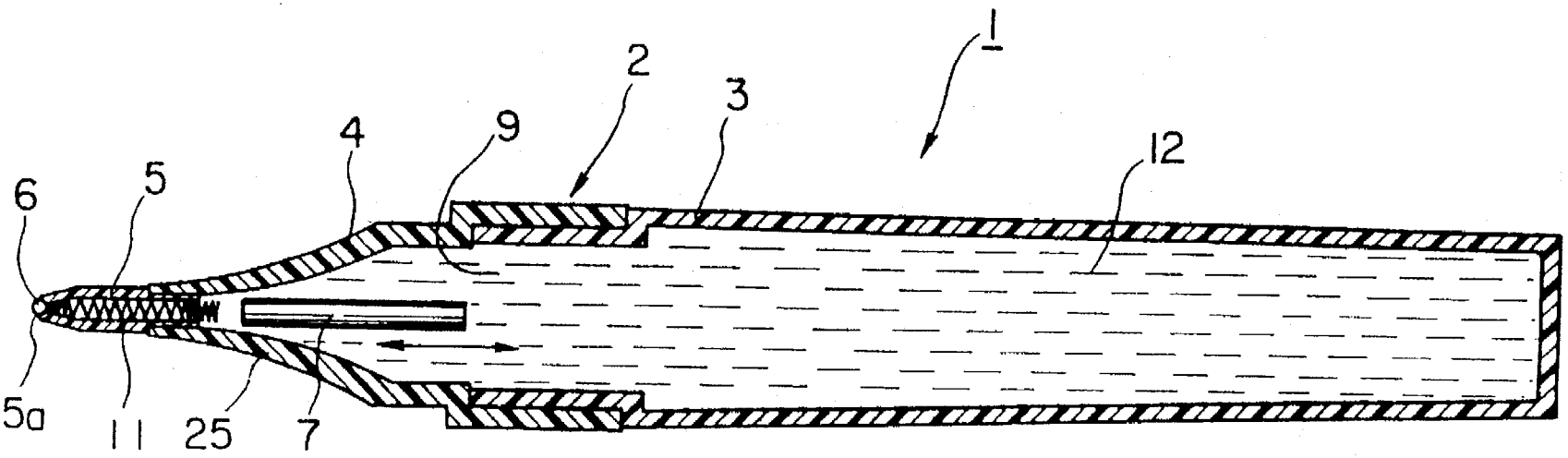
FIG. 1 is a longitudinal sectional view of a writing implement in a preferred embodiment according to the present invention.
Figure 2:
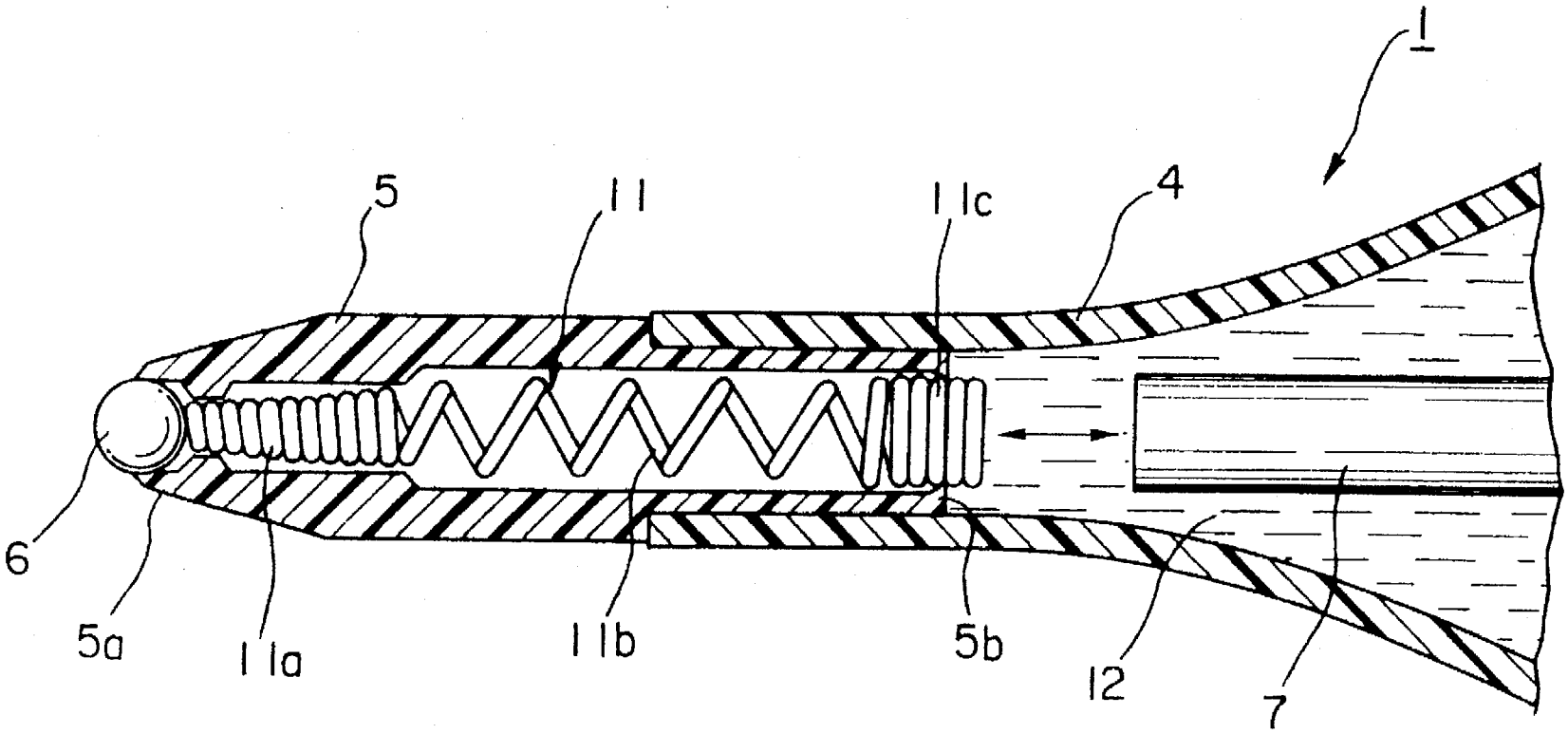
FIG. 2 is a enlarged longitudinal sectional view of a portion of the writing implement of FIG. 1.

Referring to FIG. 1, a writing implement 1 comprises a tubular barrel 2 having a main body 3 of a flexible or pliable material, a tapered barrel cap 4, a tip 5, and a writing element or ball 6. The writing implement 1 is provided internally with a bar-shaped stirring member 7 and a helical spring 11 within the tip 5. The tip 5 is tapered toward the front, and the writing ball 6 is fitted for slight axial movement in a socket formed in the conical extremity 5*a* of the tip 5. As shown in FIG. 2, stopping projections 5*b* are formed so as to project radially inward on the inner circumference of the back end of the tip 5 to restrain the helical spring 11 from moving backward out of the tip 5.

The helical spring 11 has a front portion 11*a*, a middle portion 11*b* and a back portion 11*c*. The front portion 11*a* has a length equal to about one-fourth the length of the helical spring 11, and the front portion 11*a* is coiled with a relatively small diameter and at a small pitch. Actually, the convolutions of the coil forming the front portion 11a are in mutual contact. The front end of the helical spring 11 is in contact with the writing ball 6 to bias the writing ball 6 continuously forward so that the writing ball 6 is pressed against the inner surface of the conical extremity 5*a* of the tip 5 to prevent the ink 12 contained in the barrel 2 from leaking out of the writing implement 1. The middle portion 11*b* of the helical spring 11 is coiled at a relatively large pitch with a relatively large diameter. The back portion 11*c* has a length equal to about one-fourth the length of the helical spring 11, and the back portion 11*c* is coiled at a small pitch with a diameter substantially equal to that of the coil of the middle portion 11*b*. Actually, the convolutions of the coil of the back portion 11*c* are in mutual contact. The third convolution from the back end of the helical spring 11, for example, in engagement with the stopping protrusions 5*b* of the tip 5, and the next two convolutions lie behind the back end of the tip 5.

Since the helical spring 11 has those portions 11*a*, 11*b* and 11*c* differing from each other in diameter, the bore of the chip 5 has a front portion for accommodating the front portion 11*a* of the helical spring 11, having a relatively small diameter, and a back portion for accommodating the middle portion 11*b* and the back portion 11*c* of the helical spring, having a relatively large diameter. In this embodiment, the tip 5 has a back portion of reduced outer diameter to be fitted in the front end of the tapered barrel cap 4.

When the writing implement 1 is not in use, the ink 12 contained in the writing implement 1 is unable to leak out from the writing implement 1 because the the writing ball 6 is pressed against the inner surface of the conical extremity 5*a* of the tip 5 by the front portion 11*a* of the helical spring 11. When writing pressure is applied to the writing ball 6 for writing, the position of the writing ball 6 is shifted slightly backward against the resilience of the helical spring 11 to allow the ink 12 to flow through the clearance between the writing ball 6 and the conical extremity 5*a* of the tip 5.

Since the ink is, for example, a pigment ink as mentioned above, the pigment of the ink, i.e., the dispersoid, is liable to separate from the dispersion medium and to precipitate when the writing implement 1 is left unused for awhile. When the pigment separates from the dispersion medium and precipitates, the ink is unable to flow normally for writing. The helical spring 11 functions effectively to prevent such an undesirable condition. Having the convolutions coiled at a small pitch, the front portion 11*a* of the helical spring 11 has a large contact surface exposed to the ink.

The fluctuating writing pressure acting on the writing ball 6 fluctuates the writing ball 6, whereby the helical spring 11 is caused to vibrate and writhe accordingly. The vibrations and the writhing motion of the helical spring 11 promote the dispersion of the pigment. The middle portion 11*b* of the helical spring 11 biasing the writing ball 6 forward or outward is caused to expand and contract slightly by the fluctuating writing pressure, and the slight expansion and contraction of the middle portion 11*b* promotes the dispersion of the pigment.

When the writing implement 1 is shaken, the stirring member 7 collides repeatedly against the back portion 11*c* of the helical spring 11. Shocks thus applied to the back portion 11*c* are transmitted through the middle portion 11*b* to the front portion 11*a*, significantly vibrating the middle portion 11*b*. The vibrations of the middle portion 11*b* promotes dispersion of the precipitated pigments. Since the back portion 11*c* is held in place by the stopping projections 5*b*, the helical spring 11 is not strained greatly by the shocks applied to the back portion 11*c* by the stirring member 7, and the minute vibrations of the middle portion 11*b* caused by the shocks work effectively on the precipitated pigment.

Thus, the ink is stirred by the stirring member 7 and, at the same time, the ink is caused to vibrate minutely by the minute vibrations and the writhing motion of the helical spring 11 caused by the shocks applied to the helical spring 11 by the stirring member 7 when the writing implement 1 is shaken; consequently, the components of the ink including the pigment are dispersed satisfactorily. Accordingly, faint and patchy writing and the stop of the ink flow will not occur. Since the main body 3 is flexible, the ink can be extruded by squeezing the main body 3 with fingers.

As is apparent from the foregoing description, according to the present invention, the writing implement comprises the tubular barrel containing the ink, the writing ball fitted in the socket formed in the tip of the barrel, and the ink stirring member sealed in the barrel, The spring disposed within the barrel at a position near the writing tip of the barrel so that the front end thereof is in contact with the writing ball presses the ball resiliently forward and the back end thereof can be struck by the stirring member. When the writing implement is shaken, the stirring member shakes and strikes the spring at its back end to cause the spring to vibrate and writhe, whereby the ink is stirred thoroughly by the stirring motion of the stirring member, and the vibrations and the writhing motion of the spring. Consequently, decreases in the color density of the ink and faint and patchy characters and the like formed due to insufficient feed of the ink can be prevented. Since those troubles can be prevented simply by providing the writing implement with the spring, the cost of the writing implement is hardly increased at all by the measures taken to prevent the troubles.

When the spring is a helical spring having a front portion having convolutions coiled at a relatively small pitch, a middle portion having convolutions coiled at a relatively large pitch and a back portion having convolutions coiled at a relatively large pitch, and the rear end of the helical spring is held on part of the barrel, the helical spring is not strained greatly by the shocks applied thereto by the stirring member and the shocks are converted mainly into minute vibrations of the middle portion of the helical spring, which reliably promotes dispersion of the precipitated components of the ink.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A writing implement comprising:

a tubular barrel containing an ink including a dispersion medium and a dispersoid dispersed in the medium;

a writing element fitted in a tip of the barrel;

an ink stirring member disposed within the barrel for movement therein to stir the ink so that precipitated dispersoid in the ink is dispersed when the barrel is shaken;

a spring disposed within said tip of the barrel at a position adjacent the writing element and having a front end thereof in contact with the writing element to press the element resiliently forward and a back end thereof directed toward the stirring member so that the back end can be hit by the stirring member when the barrel is shaken; and means for restraining said back end of the spring from movement relative to said tip longitudinally thereof.

2. A writing implement according to claim 1, wherein the spring is a helical spring having a front portion coiled at a relatively small pitch, a middle portion coiled at a relatively large pitch and a back portion coiled at a relatively small pitch.

3. A writing implement according to claim 2, wherein said relatively small pitch is such that coiled convolutions are in mutual contact.

4. A writing implement according to claim 2, wherein said barrel comprises a tip having a back end with radially inwardly protruding stopping projections that restrain said back end of the helical spring.

5. A writing implement according to claim 2, wherein said back portion of said spring is restrained at an intermediate portion of the back portion.

6. A writing implement according to claim 5, wherein said tip of the barrel has an inward protrusion engaging in said coiled back portion to restrain the back portion.

7. A writing implement comprising:

an element for writing with an ink;

a spring having one end and an axially opposite portion with an axially opposite end;

a barrel having an internal chamber for holding the ink, tip means for holding the element resiliently in combination with the one end of the spring and for providing the ink from the internal chamber to the element, and restraining means spaced from the tip means, in the internal chamber and engaging the spring between the one and the axially opposite ends of the spring for restraining at least part of the axially opposite portion of the spring from movement toward and away from the tip means; and stirring means comprising a member in the chamber for striking the axially opposite end of the spring, whereby to vibrate the spring and stir the ink at the tip means.

* * * * *